US006702696B1

(12) United States Patent
Nardacci

(10) Patent No.: US 6,702,696 B1
(45) Date of Patent: Mar. 9, 2004

(54) DIMPLED GOLF BALL AND DIMPLE DISTRIBUTING METHOD

(75) Inventor: Nicholas M. Nardacci, Bristol, RI (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 10/237,680

(22) Filed: Sep. 10, 2002

(51) Int. Cl.[7] ..... A63B 37/12; A63B 37/14
(52) U.S. Cl. ..... 473/383; 473/378
(58) Field of Search ..... 473/318–384

(56) References Cited

U.S. PATENT DOCUMENTS

| | | | | | |
|---|---|---|---|---|---|
| 4,389,365 | A | | 6/1983 | Kudriavetz | 264/297.8 |
| 4,720,111 | A | | 1/1988 | Yamada | |
| 4,765,626 | A | | 8/1988 | Gobush | |
| 4,869,512 | A | | 9/1989 | Nomura et al. | |
| 4,921,255 | A | * | 5/1990 | Taylor | 473/383 |
| 4,974,853 | A | | 12/1990 | Morell | |
| 5,441,276 | A | | 8/1995 | Lim | |
| 5,527,043 | A | * | 6/1996 | Shimosaka | 473/384 |
| 5,688,191 | A | | 11/1997 | Cavallaro et al. | 473/373 |
| 5,688,194 | A | | 11/1997 | Stiefel et al. | 473/383 |
| 5,713,801 | A | | 2/1998 | Aoyama | 473/354 |
| 5,772,532 | A | | 6/1998 | Stiefel et al. | 473/384 |
| 5,803,831 | A | | 9/1998 | Sullivan et al. | 473/374 |
| 5,885,172 | A | | 3/1999 | Hebert et al. | 473/354 |
| 5,919,100 | A | | 7/1999 | Boehm et al. | 473/354 |
| 5,935,023 | A | * | 8/1999 | Maehara et al. | 473/384 |
| 5,965,669 | A | | 10/1999 | Cavallaro et al. | 525/221 |
| 5,981,654 | A | | 11/1999 | Rajagopalan | 525/66 |
| 5,981,658 | A | | 11/1999 | Rajagopalan et al. | 525/72 |
| 6,056,842 | A | | 5/2000 | Dalton et al. | 156/243 |
| 6,149,535 | A | | 11/2000 | Bissonnette et al. | 473/354 |
| 6,168,407 | B1 | | 1/2001 | Kasashima et al. | 425/116 |
| 6,213,898 | B1 | | 4/2001 | Ogg | 473/383 |
| 6,254,496 | B1 | | 7/2001 | Maehara et al. | 473/378 |
| 6,527,653 | B2 | * | 3/2003 | Winfield et al. | 473/383 |
| 2001/0009310 | A1 | | 7/2001 | Herbert et al. | 264/129 |
| 2002/0025862 | A1 | | 2/2002 | Sullivan et al. | 473/374 |
| 2002/0028885 | A1 | | 3/2002 | Sullivan et al. | 525/221 |
| 2002/0123390 | A1 | | 9/2002 | Byrne et al. | 473/280 |
| 2002/0123395 | A1 | | 9/2002 | Murphy et al. | 473/378 |

* cited by examiner

*Primary Examiner*—Raleigh W. Chiu
*Assistant Examiner*—Alvin A. Hunter, Jr.
(74) *Attorney, Agent, or Firm*—Swidler Berlin Shereff Friedman, LLP

(57) ABSTRACT

A golf ball having a plurality of dimples on its surface, the dimples as a whole are distributed on at least a portion of the golf ball using principles of electromagnetic theory. The dimples placed on the golf ball surface are assigned charge values that are used to determine the electric potential. A solution method is then applied to minimize the potential by rearrangement of the dimple positions.

19 Claims, 7 Drawing Sheets

DIMPLED GOLF BALL AND DIMPLE DISTRIBUTING METHOD

This invention relates to a method of distributing dimples on a golf ball utilizing principles of electromagnetic field theory.

BACKGROUND OF THE INVENTION

One of the most fundamental equations in engineering mathematics is Laplace's Equation. A number of physical phenomena are described by this partial differential equation including steady-state heat conduction, incompressible fluid flow, elastostatics, as well as gravitational and electromagnetic fields. The theory of solutions of this equation is called potential theory.

One example of potential theory is electromagnetic field theory, which can be used to distribute objects on a spherical surface. Electromagnetic field theory has been studied extensively over the years for a variety of applications. It has been used, for example, in satellite mirror design. Electromagnetic field theory, including the obvious applications to semiconductor research and computer technology, has many applications in the physical sciences, not limited to celestial mechanics, organic chemistry, geophysics, and structural acoustics.

In many applications, the objects are treated as point charges so that principles of electromagnetic field theory can be applied to determine optimal positioning or to predict the equilibrium positions of the objects.

While the task of distributing point charges on a spherical surface has been studied extensively in mathematical circles, it has not been employed as a tool to develop and define dimple patterns or optimal dimple distributions on a golf ball.

Instead, current golf ball dimple patterns generally are based upon dividing the spherical surface of the ball into discrete polygonal surfaces. The edges of the surfaces join to form geometric shapes that approximate the spherical surface of a golf ball. These geometric shapes include, for example, regular octahedral, regular icosahedral and regular polyhedral arrangements. Once a geometric shape is selected, the polyhedral surfaces are individually filled with a dimple pattern that may be repeated over the surface.

While this approach may be effective in enabling easy dimple design and mold manufacture, it may not result in optimal dimple positioning or distribution for improved aerodynamic performance. In addition, this approach to designing a dimple pattern may result in a golf ball having variations in flight performance depending upon the direction of rotation of the ball. For instance, rotation about one axis may result in different flight characteristics than rotation about a second axis. Moreover, the difference may be large enough to produce a measurable and visible difference in aerodynamic lift and drag.

The potential limitations described above may be present in other methods for arranging dimples on a golf ball. Thus, it would be desirable to have a way to optimize a dimple pattern by repositioning the dimples to improve flight performance.

SUMMARY OF THE INVENTION

The present invention uses electromagnetic field theory implemented as a numerical computer algorithm to create dimple patterns and to optimize dimple placement and distribution on a golf ball. The method solves the constrained optimization problem where the objective function is an electric potential function subject to various constraints, such as dimple spacing or size. A number of potential functions can be utilized to describe the point charge interactions. A variety of optimization methods are available to minimize the objective function including gradient based, response surface, and neural network algorithms. These solution strategies are readily available and known to one skilled in the art. One embodiment of the present invention uses a Coulomb potential function and a gradient based solution strategy to create a dimple pattern.

One benefit from using these principles to develop dimple patterns is that doing so may result in a golf ball having improved aerodynamic performance.

Use of the inventive method provides a golf ball having a plurality of dimples on its surface, some of which have been positioned on the golf ball surface according to principles of electromagnetic theory. At first, the dimples that are to be positioned according to these principles may be randomly distributed on at least a portion of the golf ball surface. The ball surface may be divided into hemispheres, quadrants, or according to platonic solid shapes in order to define the portion of the golf ball on which the dimples will be arranged.

In one embodiment, the dimples are placed on a hemispherical portion of the golf ball. In another embodiment, the dimples are placed on the entire spherical portion of the ball. In yet another embodiment, the dimples are placed on the regions defined by an Archimedean solid, most preferably a great rhombicosidodecahedron.

The dimples may have any desired shape, although in a preferred embodiment the dimples are circular. In another embodiment, however, the dimples are polygonal in shape. In addition the dimples may be of any desired number. In one embodiment, the dimples are between about 200 to about 600 in number. In a preferred embodiment, the dimples are between about 300 to about 500 in number.

The size of the dimples may also vary. In one embodiment, the dimples are between about 0.04 to about 0.1 inches when measured from the centroid of the dimple to its outermost extremity. More preferably, the dimples are about 0.05 to about 0.09 inches in size. In yet another embodiment, the dimples are substantially circular and have varying diameters sizes from about 0.04 to about 0.20 inches, and more preferably are between about 0.100 and about 0.180 inches.

In general, the present invention involves a method for optimizing the arrangement of dimples on a golf ball under the principles developed by potential theory. In one embodiment, the steps of the method include defining a region or portion of the ball surface in which dimples will be arranged, placing dimples within the defined region or portion of the ball, and assigning charge values to each dimple. The potential of the charges are determined and a solution method is applied to minimize the potential. In a preferred embodiment, the solution method used is gradient-based. The solution method allows the dimples to be rearranged or altered and the steps repeated until the potential has reached a predetermined tolerance or has been sufficiently minimized. In a preferred embodiment, the steps are repeated until the gradient is approximately zero.

In one embodiment, at least one dimple is substantially circular, while in another embodiment a plurality of dimples are circular and have diameters from about 0.05 to about 0.200 inches. In yet another embodiment, at least one additional dimple is placed on the ball surface outside of the defined portion of the golf ball.

Some of the dimples arranged on the surface of a golf ball under the present invention may have any desired plane shape. The dimples may be, for instance, circular, oval, triangular, rhombic, rectangular, pentagonal, polygonal, or star shaped. The present invention is not limited to any minimum or maximum number of dimples that may be used, but in a preferred embodiment the total number of dimples on the golf ball is from about 200 to about 1000 dimples, and an even more preferred total number of dimples is from about 200 to about 600 dimples.

One embodiment further comprises the step of defining a portion of the ball where dimples will not be arranged. For example, it is preferred that no dimple is placed across a mold plate parting line. In yet another embodiment, the defined portion of the golf ball surface is from about one-eighth to about one half of a hemisphere of the ball surface, and more preferably corresponds to approximately one-fifth of a the ball's surface. The optimized dimple arrangement with these defined regions may be repeated on additional portions of the golf ball.

In one embodiment of the present invention the completed dimple pattern has at least about 74 percent dimple coverage, while it is preferred that the dimple surface coverage is at least about 77 percent. In another embodiment the completed dimple pattern has about 82 percent or greater surface coverage.

DESCRIPTION OF THE PREFERRED EMBODIMENTS

Figure 1:
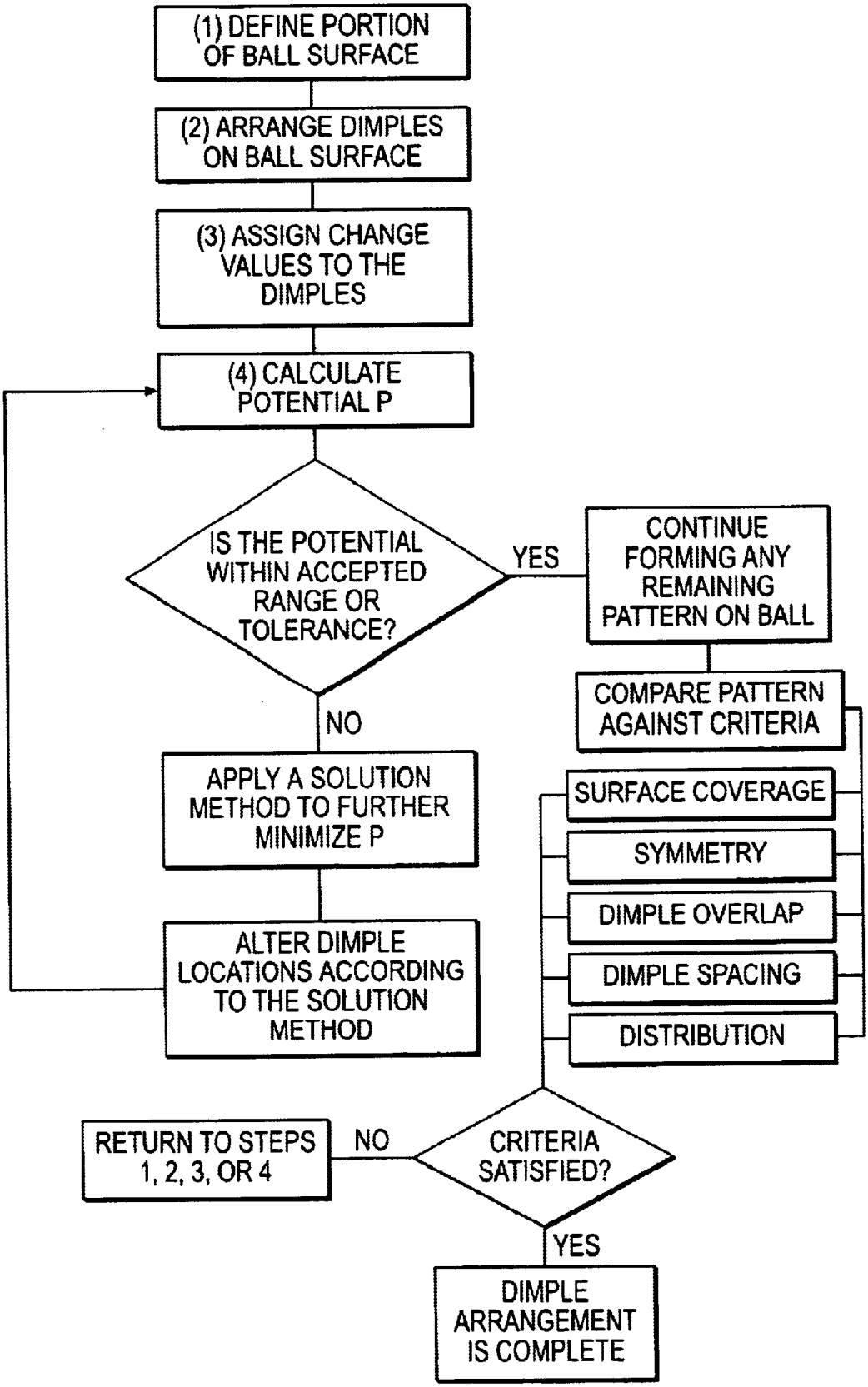
FIG. 1 illustrates one embodiment of a method of distributing four dimples on a golf ball according to the present invention.

As mentioned above, the present invention is directed to applying the principles of electromagnetic theory to develop dimple patterns for golf balls.

The foundation for the classical theory of electromagnetism is summarized by Maxwell's equations, which describe the phenomena of electricity, magnetism, and optics. These equations have a synonymous relationship with electromagnetism as Newton's Laws of motion and gravitation do with mechanics. Of particular interest in this discussion is Gauss's Law, which relate charge and the electric field generated as charged bodies interact. Electric charge is a fundamental attribute of matter as is mass, however it can be attractive or repulsive. The amount of attraction or repulsion between charged objects defines a measure of electric force. Coulomb's Law defines this vector quantity, for spherical Gaussian surfaces, as a function inversely proportional to the square of the distance between any two such charges. The following expression (Equation 1) defines Coulomb's Law:

$$\vec{F} = k\frac{q_1 q_2}{r^2} \tag{1}$$

where: F is the electric force;

$q_1$ and $q_1$ are the charges;

r is the distance between the charges; and k is a constant.

In the presence of multiple charges, forces are added vectorially to determine the total force on a particular charge. In many instances, it is convenient to introduce the concept of electric field. This quantity is the superposition of force on a charge placed in the neighborhood of a charge distribution of N charged bodies. In a sense, the charge can be thought of as a test charge, which probes the strength at various points within the electric field. The relationship between electric field and electric force can be expressed as follows (Equation 2):

$$\vec{F} = q\vec{E} \tag{2}$$

where: E is the electric field;

F is the electric force; and q is the test charge.

Substitution of equation 2 into equation 1 yields the expression for the electric field a distance r away from a point charge q (Equation 3):

$$\vec{E} = k\frac{q}{r^2} \tag{3}$$

In the presence of multiple charges, the electric field, E, is determined in a similar manner to that of electric force by vector addition of all charges q a distance r away.

The computation of vector quantities like electric force or electric field is manageable for a small number of charged bodies but quickly becomes unwieldy as the number of points increases. Fortunately, conservative forces such as electric charges have a convenient property, which allows the introduction of a scalar quantity called electric potential. In the presence of multiple charges, the total potential involves a straightforward summation of the individual charge potentials simplifying the calculation.

Further simplifications to the expression for the electric potential arise in instances where the field is constant with respect to time, known as electrostatics. For a constant electric field the electric potential energy, PE, is derived using work principles and Coulomb's Law to obey the following relationship (Equation 4):

$$PE = k\frac{q_1 q_2}{r} + C \tag{4}$$

Inclusion of the constant C in the equation q above allows the selection of the reference point where the potential is zero. Typically, this is chosen such that the potential is zero in the limit, as r becomes infinite. Under these conditions, the constant C equals zero. However, other choices are possible which provides the potential function to have other forms.

In practice, the application of electromagnetic field theory to develop dimple patterns may involve following the steps illustrated in FIG. 1. While the steps shown in FIG. 1 are illustrative of the present invention, one skilled in the art would appreciate that they may be varied or modified without departing from the spirit and scope of the invention. First, a portion of the ball is selected or defined for placing dimples. For instance, the defined space may approximately correspond to a hemispherical portion of the golf ball. Alternatively, the defined space may correspond to a portion of an Archimedean shape, a fractional portion of the curved surface of the ball. The defined space may be the entire ball surface. In yet another alternative, the defined space may correspond approximately to only a fractional portion of a hemisphere, such as from about one-eighth to about one-half of a hemisphere, or more preferably from about one-fifth to about one-fourth of a hemisphere. The pattern created within the fractional portion of the ball may then be repeated on other portions of the ball. Other examples of suitable shapes that may be used to define a portion of the ball for placing dimples may be found in co-pending U.S. patent application Ser. No. 10/078,417, for "Dimple Patterns for Golf Balls" filed on Feb. 21, 2002, which is incorporated by reference in its entirety.

Once the portion of the ball surface is defined, dimples may be initially arranged on the defined surface. The dimples may be placed randomly within the space or may be selected and arranged by any means known to those skilled in the art. In one embodiment, the dimples are initially arranged on the golf ball surface according to phyllotactic patterns. Such patterns are described, for instance, in co-pending U.S. patent application Ser. No. 10/122,189, for "Phyllotaxis-Based Dimple Patterns," filed on Apr. 16, 2002, which is incorporated by reference in its entirety. Any additional techniques or patterns used for dimple arrangement known to those skilled in the art likewise may be used.

Once the dimples are arranged on the ball surface, each dimple is then assigned a charge value that can be used in the equations described above. Different charge values may be provided for dimples differing in size or shape in order to account for these differences. Alternatively, the dimples may be assigned similar charge values with differences in dimple sizes or shapes accounted for afterwards in any suitable manner.

The assigned charge values and positions of the dimples are then utilized to determine the potential energy PE, referred to from hereon as just the potential. Once the potential is determined, a solution method is then used to minimize PE. In one embodiment, the solution method used is gradient-based. The dimple locations are subsequently altered and the analysis is repeated until the potential PE reaches zero or an acceptable minimum within a specified tolerance. Examples of acceptable minimums may include when further iteration causes PE to change by less than 1 percent or ½ percent.

Any number of convergence criteria may be used to halt the optimization process. One skilled in the art will appreciate that error analysis and rate of convergence are essential elements in the implementation of any iterative numerical algorithm. Therefore, it is sufficient to note that an acceptable solution may be found when an appropriate convergence criteria or criterion is satisfied. If the potential PE is not within an accepted range or tolerance, the dimple locations are altered accordingly and the process is repeated. The potential PE is recalculated and compared again to the accepted range or tolerance. This process may be repeated until the dimple locations fall within acceptable tolerances.

More than one solution method may be utilized to further minimize the potential. For instance, numerical optimization can include a multi-method approach as well where a gradient method is used to identify a good initial guess at the minimum and then higher order methods, such as a Newton or Quasi-Newton methods, may be used to accelerate the rate of convergence. Once the potential PE is zero or within an accepted range or tolerance, the dimples no longer need to be repositioned.

As mentioned above, the arrangement of the dimples on the surface of the golf ball according to the concepts described herein may be performed on the entire surface of the golf ball or a portion thereof. In one embodiment, the surface is approximately half of the surface of the ball, preferably with allowance for dimples to not be placed near the parting line of the mold assembly. Thus, a portion of the surface of the golf ball, such as a mold parting line, may be designated as not being suitable for placement of dimples.

Likewise, portions of the golf ball surface may be configured with dimples that are not adjusted according to the methods described herein. For instance, the location and size of dimples on a golf ball corresponding to a vent pin or retractable pin for an injection mold may be selected in order to avoid significant retooling of molding equipment. Maintaining the selected size and position of these dimples may be accomplished by defining the portions of the ball where dimples will be arranged according to the methods described herein so that the defined portion of the ball surface excludes the dimples that are to remain in their selected position.

When the dimples are rearranged on only a portion of the golf ball, the pattern generated may be repeated on the remaining surface of the ball or on another portion of the golf ball. For instance, if the surface on which the dimples are arranged corresponds approximately to a hemisphere of the ball, the pattern may be duplicated on the remainder of the ball surface that corresponds to a similar approximation of a hemisphere. If the dimples are arranged on smaller regions, the pattern generated may be duplicated or repeated on other portions of the ball. Thus, it is not necessary that the totality of the defined spaces in which the dimples cover the entire golf ball. Any undefined spaces may have additional dimples added either before or after the process described herein for arranging dimples in the defined space.

Returning again to FIG. 1, once the potential is zero or within an accepted range or tolerance, any remaining portions or undefined spaces on the ball may be filled in with additional dimples. As mentioned above, dimples may be placed in these remaining portions or undefined spaces in any manner, including by use of the present invention. Once all of the dimples have been arranged on the ball, the pattern then may be compared to any combination of acceptance criteria to determine whether the dimple arrangement is complete.

Examples of suitable acceptance criteria may include, but are not limited to, surface coverage, pattern symmetry, overlap, spacing, and distribution of the dimples. For example, a pattern having less than 65 percent dimple coverage may be rejected as not having sufficient dimple surface coverage, whereas a pattern having about 74 percent or more surface coverage may be acceptable. More preferably, the surface coverage of the pattern is about 77 percent or greater, and even more preferably is about 82 percent or greater.

Dimple distribution is another factor that may be included as part of the acceptance criteria of a dimple pattern. For instance, the pattern may be rejected if dimples of a particular size are concentrated in a localized area instead of being relatively uniformly distributed on the ball surface or region of the surface.

Dimple overlap and spacing are additional factors that may be considered when evaluating a dimple pattern. It is preferred that the outer boundary of one dimple does not intersect with the outer boundary of another dimple on the ball. If this occurs, either one or both of the overlapping dimples may be repositioned or altered in size in order to remedy the overlap. Once this dimple size or position has been altered, it may be desirable to reanalyze the potential and apply a solution method until it reaches zero or an accepted range or tolerance. The same steps may also be taken when dimple spacing is at issue instead of dimple overlap. Thus, dimples deemed too close to each other or perhaps too close to a particular region of the ball, such as the parting line of the mold, may be resized or repositioned in the manner described above.

As stated above, any combination of acceptance criteria may be used to evaluate the dimple pattern. If the acceptance criteria are met, dimple arrangement is complete. However, if any of the selected acceptance criteria is not met, any one of steps 1–4 as indicated in FIG. 1 may be repeated to further modify the dimple pattern and reevaluate the pattern against the acceptance criteria. Thus, the portion of the ball surface may be redefined, the dimples may be rearranged, different charge values may be assigned to one or more dimples to reflect a new dimple diameter, or the potential of the overall dimple pattern may be calculated and further minimized. It should be noted that the number designations shown for steps 1–4 in FIG. 1 do not denote that these steps must be completed or performed in any particular order. Thus, for instance, step 3 may be performed prior to performing step 2.

The arranged dimples may be of any desired size or shape. For example, the dimples may have a perimeter that is approximately a circular plane shape (hereafter referred to as circular dimples) or have a perimeter that is non-circular. Some non-limiting examples of non-circular dimple shapes include oval, triangular, rhombic, rectangular, pentagonal, polygonal, and star shapes. Of these, circular dimples are preferred. A mixture of circular dimples and non-circular dimples is also acceptable, and the sizes of the dimples may be varied as well. Several additional non-limiting examples of dimple sizes and shapes that may be used with the present invention are provided in U.S. patent application Ser. No. 09/404,164, filed Sep. 27, 1999, entitled "Golf Ball Dimple Patterns," and U.S. Pat. No. 6,213,898, the entire disclosures of which are incorporated by reference herein.

In addition to varying the perimeter and size of the dimples, the cross-sectional profile of the dimples may be varied. In one embodiment, the profile of the dimples correspond to a catenary curve. This embodiment is described in further detail in U.S. application Ser. No. 09/989,191, entitled "Golf Ball Dimples with a Catenary Curve Profile" filed on Nov. 21, 2001, which is incorporated by reference herein in its entirety. Another example of a cross-sectional dimple profile that may be used with the present invention is described in U.S. application Ser. No. 10/077,090, entitled "Golf Ball with Spherical Polygonal Dimples" filed on Feb. 15, 2002, which also is incorporated by reference herein in its entirety. Other dimple profiles, such as spherical ellipsoidal, or parabolic, may be used as well without departing from the spirit and scope of the present invention. In addition, the dimples may have a convex or concave profile, or any combination thereof.

As mentioned above, the defined space for arranging the dimples may approximately correspond to a hemispherical portion of the golf ball, although smaller or larger regions also may be selected. Defining the space in this manner may have particular benefit when the mold that forms the cover has a parting line near the hemisphere of the ball.

The defined space may be selected to correspond approximately to a cavity formed by one mold plate. In this situation, a boundary or region may be imposed near the parting line of the mold so that the dimples are not formed too close to where the mold plates meet. For instance, a boundary may be imposed so that no portion of a dimple is formed within 0.005 inches or less of the mold parting line. Preferably, this boundary would be approximately the same distance from the parting line on the corresponding mold plate.

This technique for defining the space to correspond to a mold cavity may be used even if the corresponding mold plates do not have the same dimensions or configurations. For instance, the parting line of the mold may be offset, as described for instance in U.S. Pat. No. 4,389,365 to Kudriavetz, the disclosure of which is incorporated by reference in its entirety. Additionally, the parting line of the mold may not occur in a single plane, as described for example in copending application Ser. No. 10/078,417. Other molds may have dimples that cross the parting line such described in U.S. Pat. No. 6,168,407, which is incorporated by reference in its entirety. It is not necessary, however, that the defined space is limited to space formed by a single mold plate.

Application of the present invention is not limited to any particular ball construction, nor is it restricted by the materials used to form the cover or any other portion of the golf ball. Thus, the invention may be used with golf balls having solid, liquid, or hollow centers, any number of intermediate layers, and any number of covers. It also may be used with wound golf balls, golf balls having multilayer cores, and the like. For instance, the present invention may be used with a golf ball having a double cover, where the inner cover is harder than the outer cover. If a double cover is used with the present invention, it is preferred that the difference is Shore D hardness between the outer cover and the inner cover is at least about 5 Shore D when measured on the ball, and more preferably differs by about 10 or more Shore D.

Other non-limiting examples of suitable types of ball constructions that may be used with the present invention include those described in U.S. Pat. Nos. 6,056,842, 5,688,191, 5,713,801, 5,803,831, 5,885,172, 5,919,100, 5,965,669, 5,981,654, 5,981,658, and 6,149,535 as well as publication Nos. US2001/0009310 A1, US2002/0025862 A1, and US2002/0028885 A1. The entire disclosures of these patents and published applications are incorporated by reference herein.

The invention also is not limited by the materials used to form the golf ball. Examples of suitable materials that may be used to form different parts of the golf ball include, but are not limited to, those described in copending application Ser. No. 10/228,311, for "Golf Balls Comprising Light Stable Materials and Method of Making the Same," filed on Aug. 27, 2002, the entire disclosure of which is incorporated herein. In one embodiment of the present invention, the outer cover material comprises a polyurethane composition, while in another embodiment the cover is formed from a polyurea-based composition.

EXAMPLES

In addition to the description above, the following examples further illustrate how the present invention can be used to arrange dimples on a golf ball.

FIGS. 2–7 show the initial and final point configurations for three examples described more fully below. Tables 1–3, also provided below, show run history information of the computed potential energy and gradient for the iterative analysis previously described. Additional fields provide a measure of the point separation as the run progresses. The key elements in the tables are the computed potential, the gradient of the computed and known minimum potential values and minimum spacing. In examples 1 and 2, there is good agreement between the computed and known minimum potential values and minimum spacing distances.

A tighter convergence tolerance would further increase the level of accuracy. Tables 1 and 2 show the tabulated data and plot of iteration count versus the computed gradient. As shown, the gradient approach has a linear rate of convergence. While improvements on solution speed and accuracy may be gained by utilizing more robust algorithms, the implementation of the inventive method described herein nevertheless sufficiently describes the utility of the method.

Example 1

Figure 2:
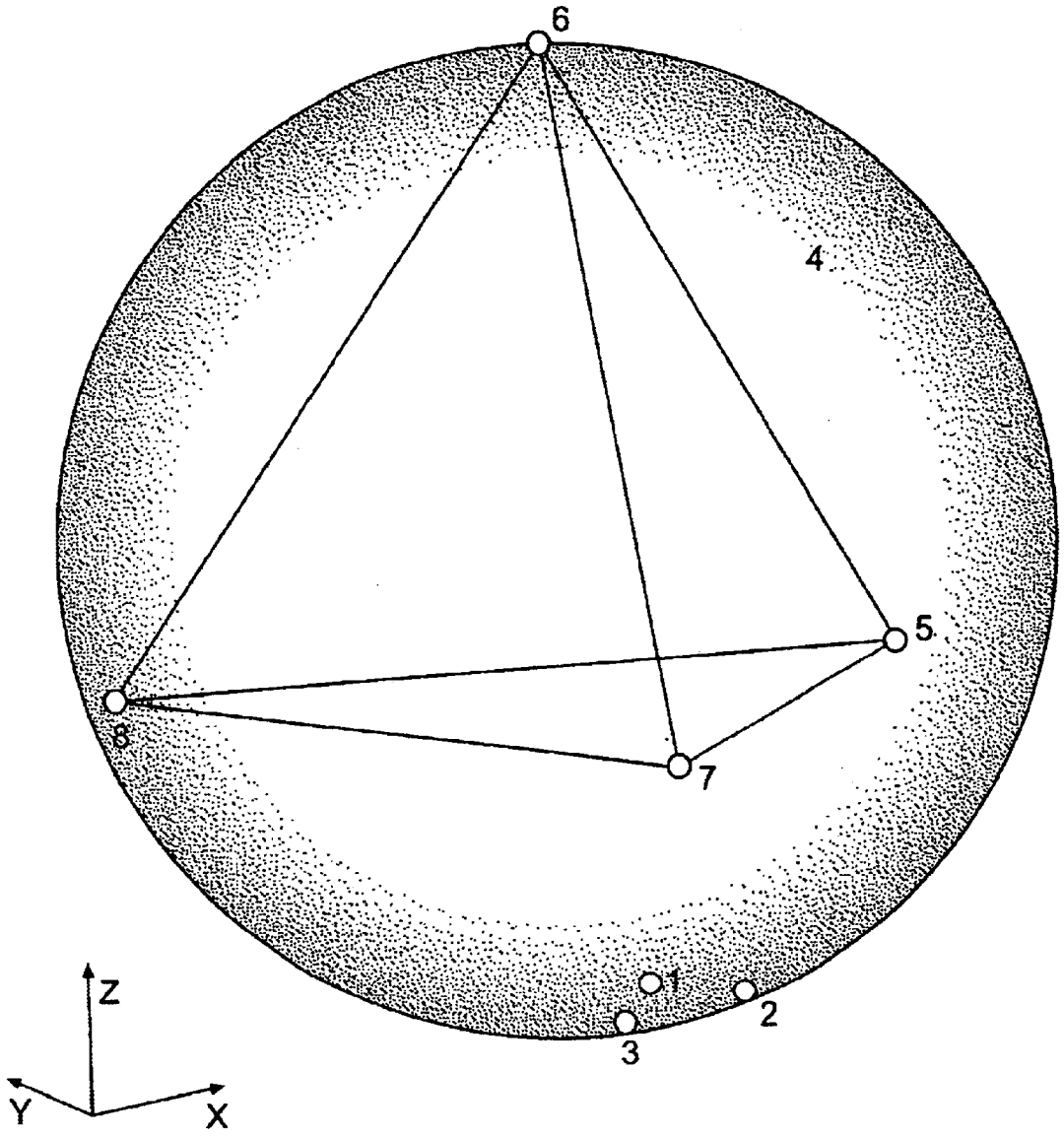
FIG. 2 is an example of a dimple arrangement according to the present invention.

The first example, shown in FIG. 2, utilizes only four points to provide a simplified illustration of how the present invention can be used to arrange dimples on a spherical surface. In this example, the defined surface corresponds to a unit sphere. The four points are randomly placed in any location on the surface of the sphere, as represented by numbers 1–4, and assigned identical charge values. Using a computer, the potential, gradient, minimum distance between any two points and average distance between all of them is calculated. The dimples are then repositioned according to a gradient based solution method and reevaluated. As shown in FIG. 1, and as further illustrated in Table 1 below, this process is repeated in this example until the gradient is approximately zero.

TABLE 1

| Iteration No. | Potential PE | Gradient | Minimum Distance | At Vertices | Average Distance |
|---|---|---|---|---|---|
| 1 | 8.205 | 12.230 | 0.5039 | 0, 1 | 1.1331 |
| 26 | 4.422 | 1.520 | 1.076 | 0, 1 | 1.4273 |
| 51 | 4.069 | 0.925 | 1.2469 | 0, 1 | 1.5165 |
| 76 | 3.914 | 0.663 | 1.3412 | 0, 1 | 1.5626 |
| 101 | 3.829 | 0.505 | 1.4027 | 0, 1 | 1.5889 |
| 126 | 3.779 | 0.398 | 1.4466 | 0, 1 | 1.6048 |
| 151 | 3.746 | 0.321 | 1.4797 | 0, 1 | 1.6146 |
| 176 | 3.725 | 0.263 | 1.5057 | 0, 1 | 1.6208 |
| 201 | 3.711 | 0.219 | 1.5265 | 0, 1 | 1.6248 |
| 226 | 3.700 | 0.184 | 1.5436 | 0, 1 | 1.6274 |
| 251 | 3.693 | 0.156 | 1.5571 | 0, 2 | 1.6292 |
| 276 | 3.688 | 0.132 | 1.5684 | 0, 2 | 1.6303 |
| 301 | 3.684 | 0.113 | 1.578 | 0, 2 | 1.6311 |
| 326 | 3.682 | 0.097 | 1.5862 | 0, 2 | 1.6317 |
| 351 | 3.680 | 0.083 | 1.5932 | 0, 2 | 1.6321 |
| 376 | 3.678 | 0.071 | 1.5993 | 0, 2 | 1.6323 |
| 401 | 3.677 | 0.060 | 1.6044 | 0, 2 | 1.6325 |
| 426 | 3.676 | 0.051 | 1.6088 | 0, 2 | 1.6327 |
| 451 | 3.676 | 0.044 | 1.6125 | 0, 2 | 1.6328 |
| 476 | 3.675 | 0.037 | 1.6157 | 0, 2 | 1.6328 |
| 501 | 3.675 | 0.032 | 1.6184 | 0, 2 | 1.6329 |
| 526 | 3.675 | 0.027 | 1.6207 | 0, 2 | 1.6329 |
| 551 | 3.675 | 0.023 | 1.6226 | 0, 2 | 1.6329 |
| 576 | 3.675 | 0.019 | 1.6242 | 0, 2 | 1.633 |
| 601 | 3.674 | 0.016 | 1.6256 | 0, 2 | 1.633 |
| 626 | 3.674 | 0.014 | 1.6268 | 0, 2 | 1.633 |
| 651 | 3.674 | 0.012 | 1.6278 | 0, 2 | 1.633 |
| 676 | 3.674 | 0.010 | 1.6286 | 0, 2 | 1.633 |
| 701 | 3.674 | 0.008 | 1.6293 | 0, 2 | 1.633 |
| 726 | 3.674 | 0.007 | 1.6299 | 0, 2 | 1.633 |
| 751 | 3.674 | 0.006 | 1.6304 | 0, 2 | 1.633 |
| 776 | 3.674 | 0.005 | 1.6308 | 0, 2 | 1.633 |
| 801 | 3.674 | 0.004 | 1.6311 | 0, 2 | 1.633 |
| 826 | 3.674 | 0.004 | 1.6314 | 0, 2 | 1.633 |
| 842 | 3.674 | 0.003 | 1.6316 | 0, 2 | 1.633 |

Figure 3:
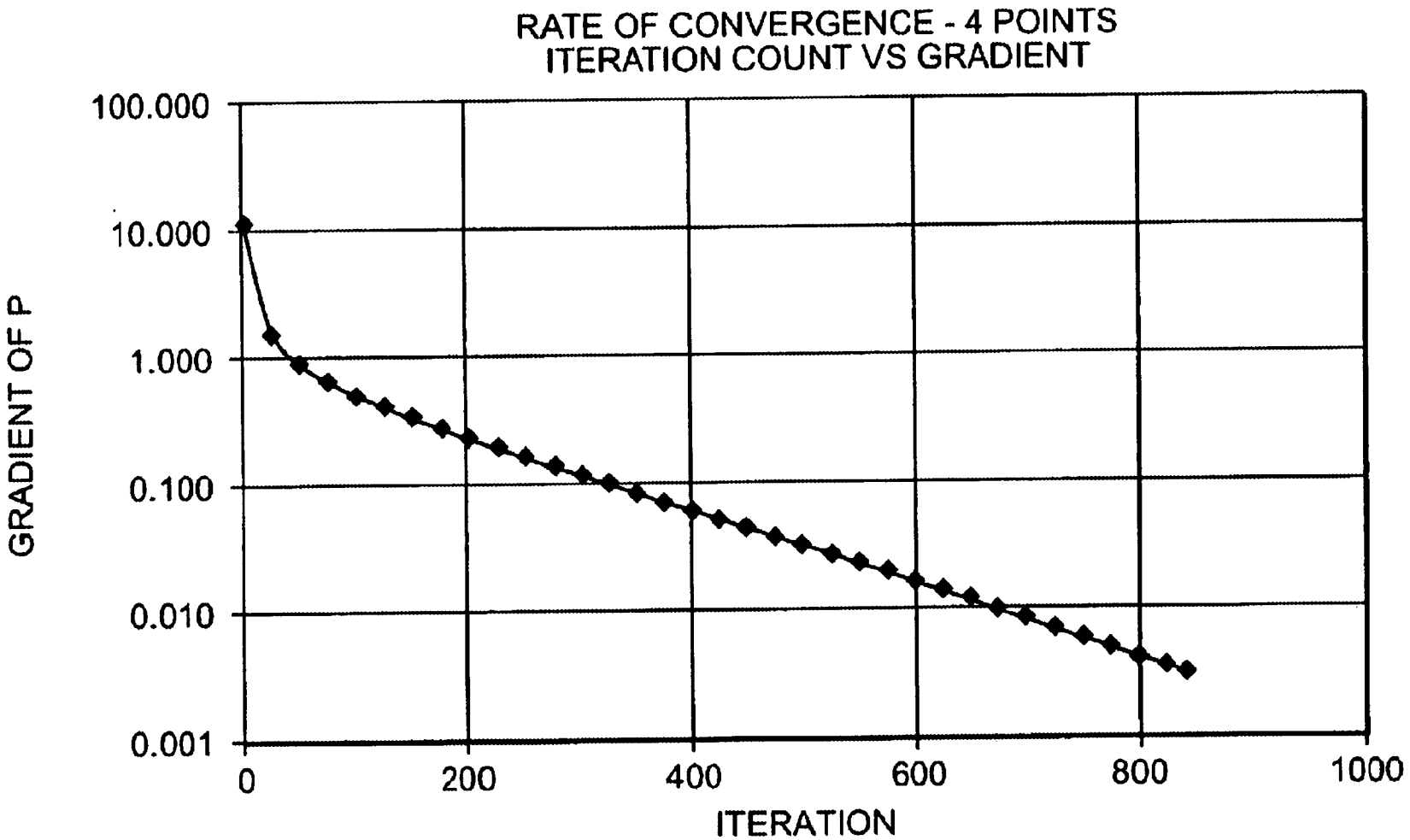
FIG. 3 is a graph of the rate of convergence for the example illustrated in FIG. 2.

The resulting point locations 5–8 derived using the inventive method described herein are shown in FIG. 2. Each point is approximately the same distance, in this case about 1.63 inches, from any other point arranged on the sphere. FIG. 3 is a graph of the rate at which the gradient converges to zero. As shown, the rate of convergence is generally linear for the solution method used in this example. The process was stopped after 842 iterations when the gradient reached a value that was approximately zero.

Example 2

Figure 4:
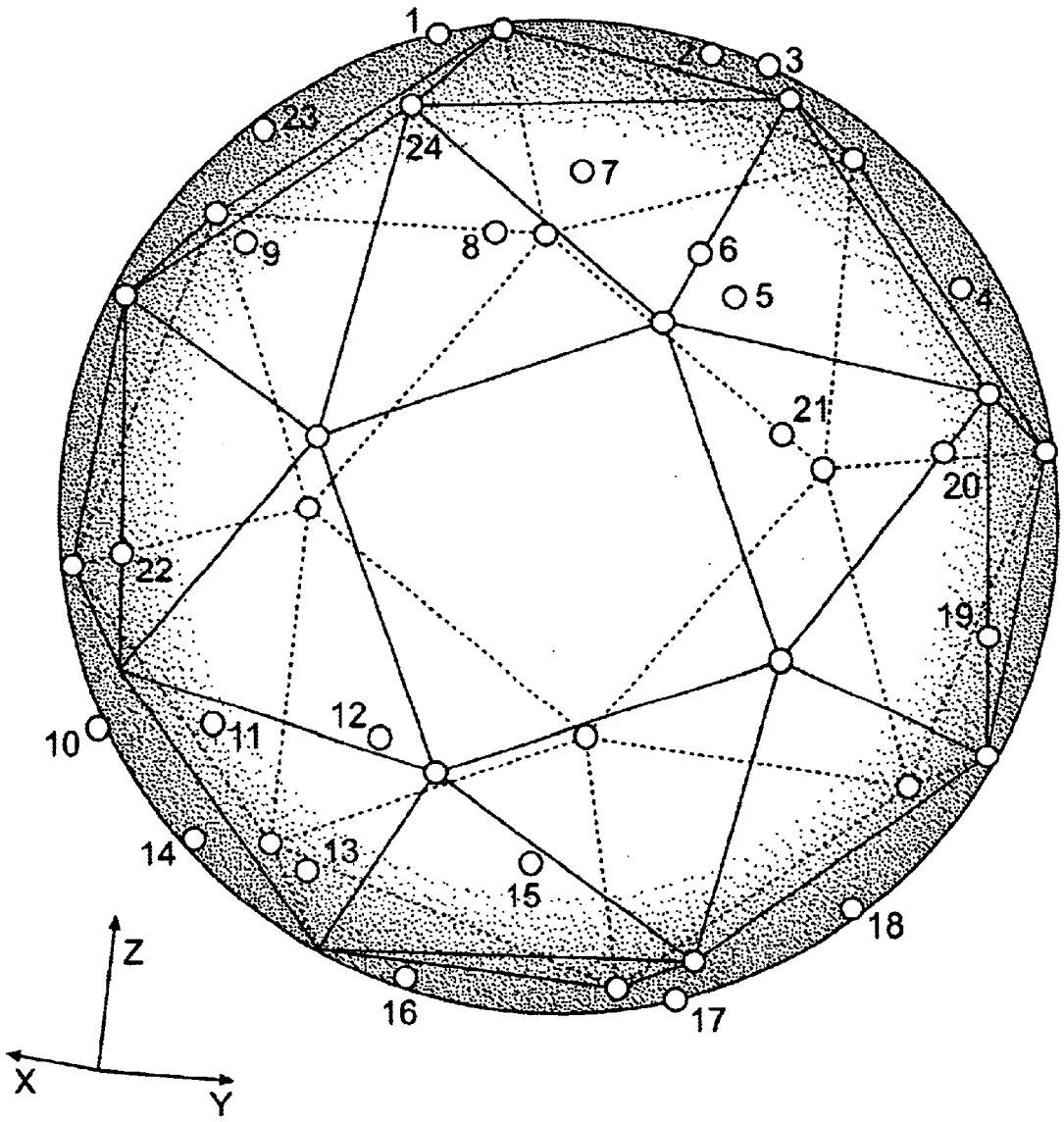
FIG. 4 is an example of an initial dimple arrangement of 24 dimples on a golf ball.

The second example uses the methods described herein to arrange 24 dimples on a golf ball. In this example, the initial dimple locations 1–24 once again are randomly arranged on the surface of the golf ball. The initial configuration of the dimple locations 1–24 is shown in FIG. 4. Charge values are assigned, and the potential, gradient, and minimum and average distances are again calculated. The process is repeated as described above for Example 1 until the dimple locations are optimized. Although the optimized dimples are not numbered, FIG. 4 shows the optimized positioning of the dimples, which coincide with vertices of an Archimedean shape.

Figure 5:
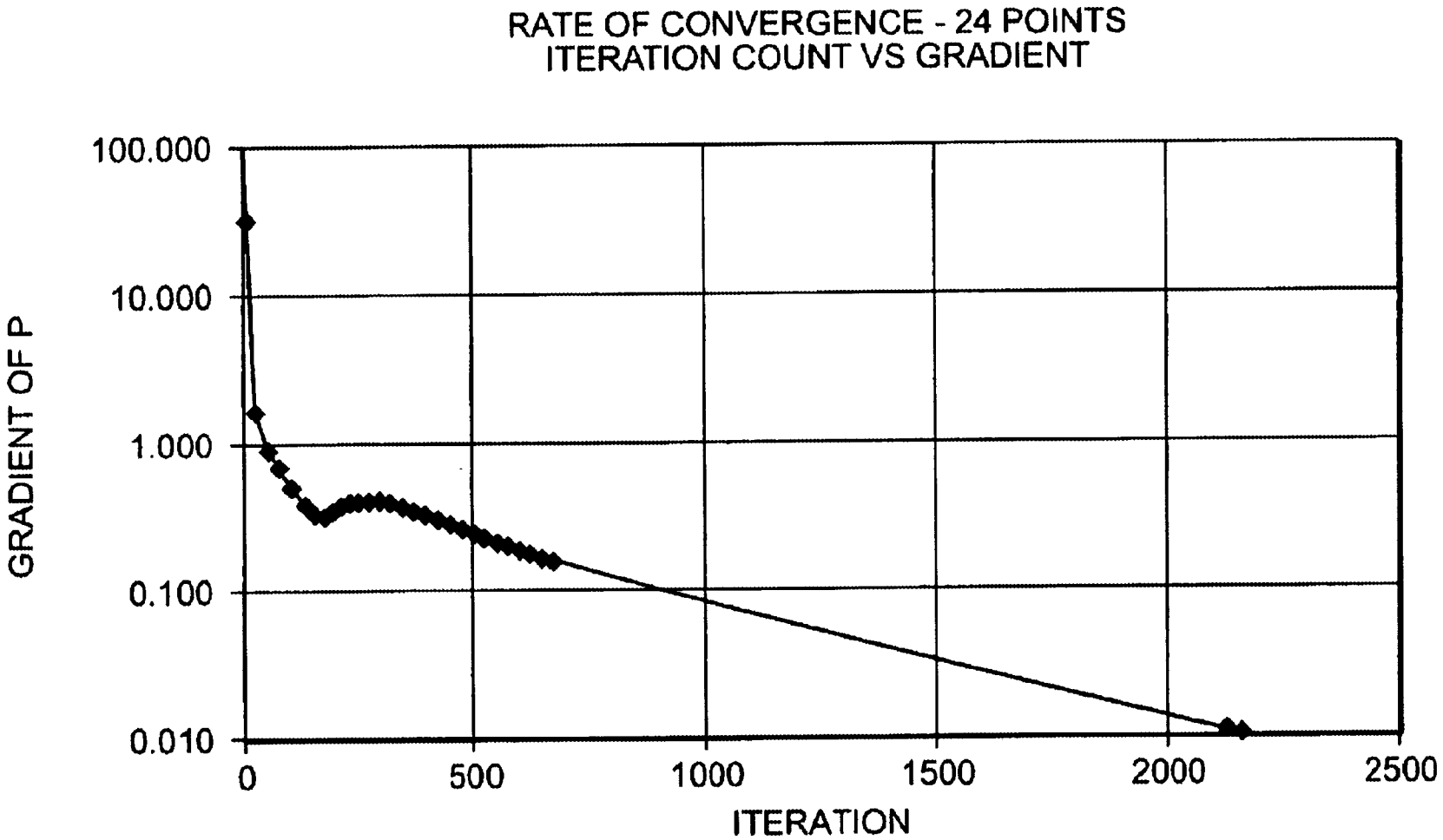
FIG. 5 is a graph of the rate of convergence for the example illustrated in FIG. 4.

As shown in FIG. 5, the rate of convergence again is was approximately linear. Table 2, below, provides illustrative data showing the calculations performed in this example. In this example, the process was stopped after 2160 iterations when the gradient reached an acceptable tolerance. Although not utilized in this Example, additional solution methods, including higher order methods, could be used to minimize the potential more rapidly.

As shown in Table 2, below, the iterative process was completed after the gradient was within an acceptable tolerance.

TABLE 2

| Iteration No. | Potential PE | Gradient | Minimum Distance | At Vertices | Average Distance |
|---|---|---|---|---|---|
| 1 | 248.193 | 32.640 | 0.4433 | 4, 7 | 0.5996 |
| 26 | 224.125 | 1.700 | 0.6087 | 0, 2 | 0.6943 |
| 51 | 223.806 | 0.884 | 0.6253 | 3, 12 | 0.7041 |
| 76 | 223.653 | 0.677 | 0.6431 | 0, 2 | 0.7114 |
| 101 | 223.566 | 0.495 | 0.6566 | 0, 2 | 0.7158 |
| 126 | 223.520 | 0.372 | 0.667 | 0, 2 | 0.7178 |
| 151 | 223.491 | 0.317 | 0.6709 | 1, 3 | 0.7193 |
| 176 | 223.469 | 0.311 | 0.6709 | 1, 3 | 0.7205 |
| 201 | 223.453 | 0.349 | 0.6711 | 1, 3 | 0.7213 |
| 226 | 223.438 | 0.373 | 0.6714 | 1, 3 | 0.7222 |
| 251 | 223.424 | 0.384 | 0.6722 | 1, 3 | 0.7229 |
| 276 | 223.411 | 0.385 | 0.6736 | 1, 3 | 0.7236 |
| 301 | 223.400 | 0.378 | 0.6756 | 1, 3 | 0.7244 |
| 326 | 223.390 | 0.364 | 0.678 | 1, 3 | 0.7252 |
| 351 | 223.383 | 0.345 | 0.6806 | 1, 3 | 0.7259 |
| 376 | 223.377 | 0.325 | 0.683 | 1, 3 | 0.7265 |
| 401 | 223.372 | 0.305 | 0.6853 | 1, 3 | 0.7271 |
| 426 | 223.369 | 0.285 | 0.6874 | 1, 3 | 0.7277 |
| 451 | 223.366 | 0.267 | 0.6893 | 1, 3 | 0.728 |
| 476 | 223.363 | 0.250 | 0.6909 | 1, 3 | 0.7284 |
| 501 | 223.361 | 0.234 | 0.6925 | 1, 3 | 0.7287 |
| 526 | 223.359 | 0.220 | 0.6939 | 1, 3 | 0.729 |
| 551 | 223.358 | 0.206 | 0.6953 | 1, 3 | 0.7293 |
| 576 | 223.356 | 0.194 | 0.6965 | 1, 3 | 0.7296 |
| 601 | 223.355 | 0.182 | 0.6977 | 1, 3 | 0.7299 |
| 626 | 223.354 | 0.172 | 0.6988 | 1, 3 | 0.7302 |
| 651 | 223.353 | 0.162 | 0.6999 | 1, 3 | 0.7304 |
| 676 | 223.352 | 0.152 | 0.7009 | 1, 3 | 0.7307 |
| 2126 | 223.347 | 0.011 | 0.7165 | 1, 3 | 0.7337 |
| 2151 | 223.347 | 0.010 | 0.7166 | 1, 3 | 0.7337 |
| 2160 | 223.347 | 0.010 | 0.7166 | 1, 3 | 0.7337 |

Example 3

Figure 6:
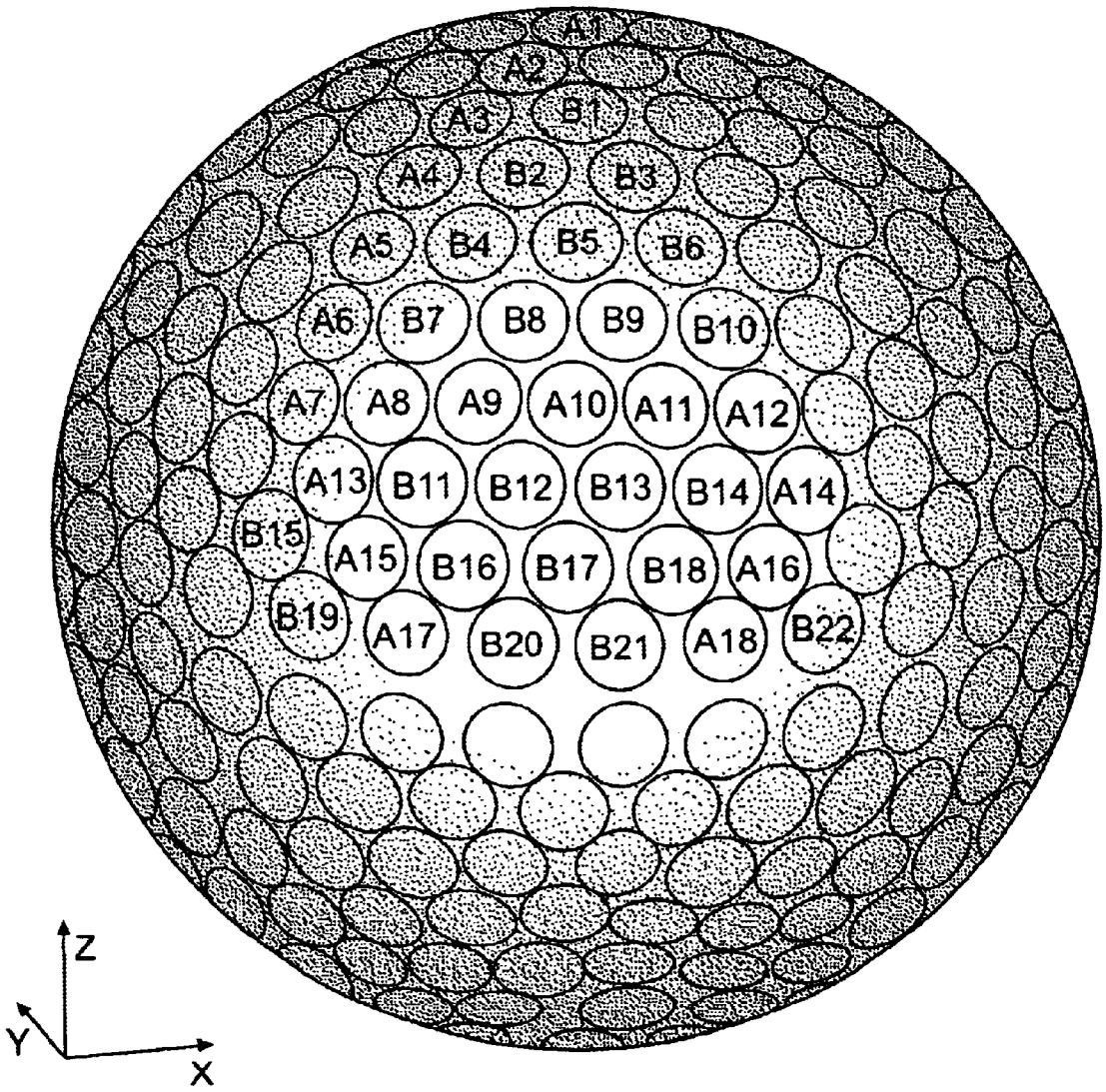
FIG. 6 is an example of an initial dimple configuration of 392 dimples on a golf ball.
Figure 7:
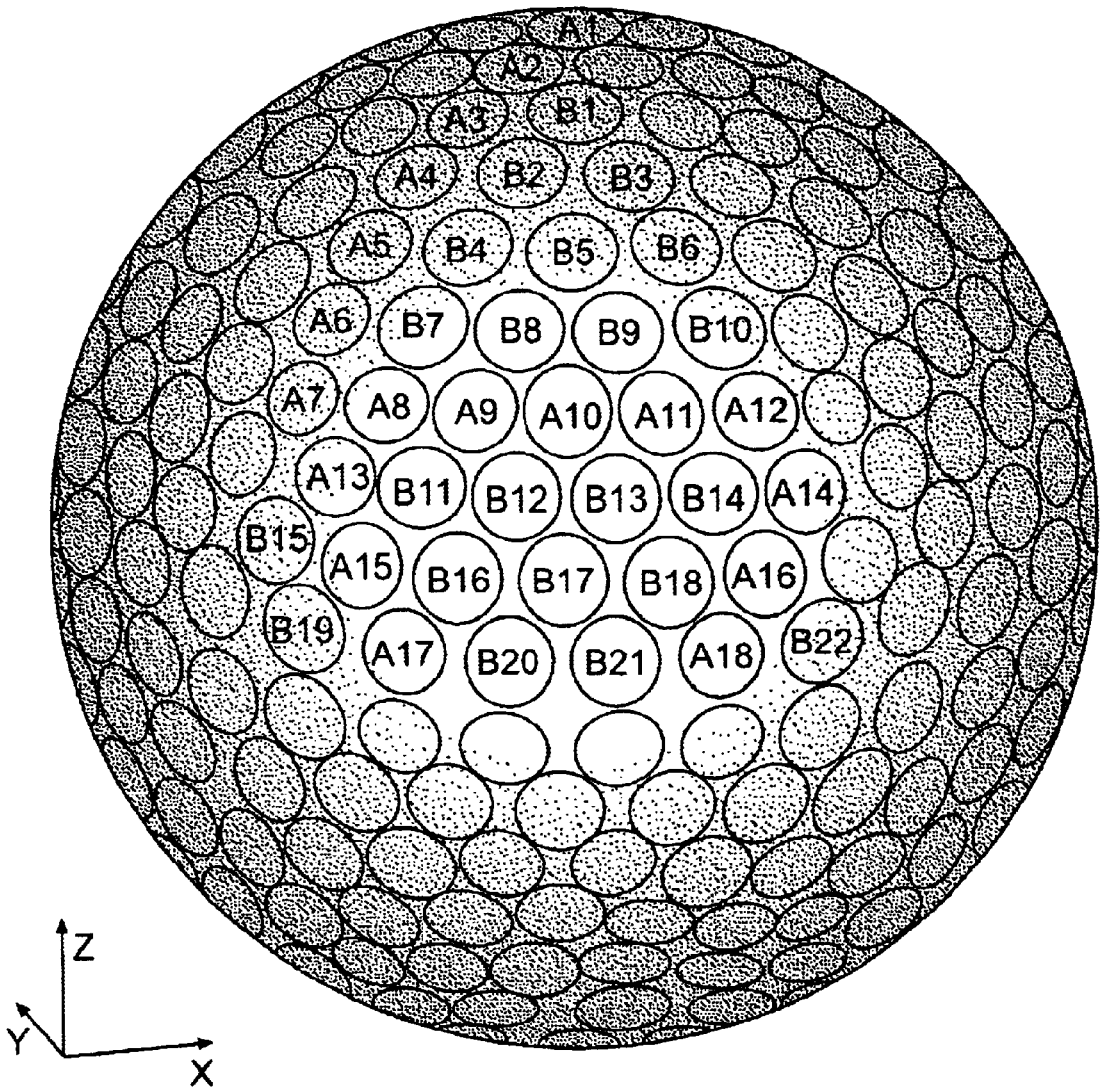
FIG. 7 illustrates a final configuration and spacing of dimples for the golf ball of FIG. 6.

FIGS. 6 and 7 show the initial and final dimple configurations for a 392-icosahedron dimple layout with two dimple diameters. It is provided that 392 circular dimples are distributed on the entire spherical surface of a golf ball. Using a computer, an initial distribution of dimples is set on a hemispherical surface of a golf ball model. The initial distribution shown in FIG. 6 is based on a conventional icosahedral arrangement of dimples. In this example, there are two dimple sizes on the ball. The first set of dimples have a diameter of about 0.139 inches, while the second set of dimples are about 0.148 inches in diameter. Each hemisphere of the ball has 196 dimples.

As seen in FIG. 6, the initial dimple pattern shows large polar spacing and tighter packing toward the equator of the ball, but maintains a sufficient setback from the equator of the ball. In this example, the defined space for redistributing the dimples is approximately a hemisphere with a constraint that the dimples not be placed within 0.006 inches from the parting line corresponding generally to the equator of the ball. Charge values are assigned to each dimple and the equations are applied and repeated until the gradient reaches a selected tolerance. As shown in FIG. 7, the dimple pattern that results from application of the present invention has the dimples more uniformly spaced from each other.

Although some preferred embodiments have been described, many modifications and variations may be made thereto in light of the above teachings without departing from the spirit and scope of the present invention. It is therefore to be understood that the invention may be practiced otherwise than specifically described without departing from the scope of the appended claims.

What is claimed is:

1. A method for optimizing the arrangement of dimples on a golf ball using the principles of electromagnetic theory, comprising the steps of:

defining a portion of the golf ball surface in which dimples will be arranged;

placing a first plurality of dimples within the defined surface;

assigning charge values to said dimples;

determining the potential of the charges;

applying a solution method to minimize the potential; and altering the dimple location and distribution according to the solution method.

2. The method of claim 1, wherein the solution method used comprises a gradient-based solution.

3. The method of claim 2, wherein the steps of determining potential, applying a solution method, and altering dimple locations are repeated until the dimple arrangement is within a predetermined tolerance.

4. The method of claim 3, wherein the steps are repeated until the gradient is approximately zero.

5. The method of claim 1, wherein at least one dimple is substantially circular.

6. The method of claim 1, wherein the first plurality of dimples are circular and have diameters between about 0.05 and about 0.200 inches.

7. The method of claim 1, further comprising the step of placing at least one additional dimple on the golf ball outside of the defined portion of the golf ball.

8. The method of claim 1, wherein the first plurality of dimples have any desired plane shape including circular, oval, triangular, rhombic, rectangular, pentagonal, polygonal and star shapes.

9. The method of claim 1, wherein the total number of the dimples on the golf ball is from about 200 to about 1000 dimples.

10. The method of claim 9, wherein the total number of the dimples on the golf ball is from about 200 to about 600 dimples.

11. The method of claim 1, further comprising the step of defining a portion of the ball where dimples will not be arranged.

12. The method of claim 11, wherein the step of defining a portion of the ball where dimples will not be arranged comprises a portion of the ball corresponding to a mold assembly parting line.

13. The method of claim 1, wherein the defined portion of the golf ball surface corresponds to approximately one-fifth of a hemisphere of the ball surface.

14. The method of claim 13, wherein the optimized dimple arrangement within the defined portion is repeated on additional portions of the golf ball.

15. The method of claim 1, wherein after arrangement of the dimples is completed the surface coverage of the pattern is about 77 percent or greater.

16. The method of claim 15, wherein the completed dimple pattern has about 82 percent or greater surface coverage.

17. A method for optimizing the arrangement of dimples on a golf ball comprising the steps of:

defining a portion of the golf ball surface in which dimples will be arranged;

placing a first plurality of dimples within the defined surface;

assigning charge values to said dimples;

determining the potential of the charges;

applying a solution method to minimize the potential; and altering the dimple location and distribution according to the solution method;

optionally adding additional dimples to the golf ball surface to arrive at a completed dimple pattern, wherein said dimple pattern has a surface coverage of about 74 percent or greater.

18. The method of claim 17, wherein the optimized dimple arrangement within the defined portion is repeated on additional portions of the golf ball.

19. The method of claim 17, wherein the solution method used comprises a gradient-based solution.

* * * * *